US005234489A

United States Patent [19]

Streicher et al.

[11] Patent Number: 5,234,489

[45] Date of Patent: Aug. 10, 1993

[54] PROCESS FOR REDUCING OXIDES CONTAINED IN IRON POWDER WITHOUT SUBSTANTIAL DECARBURIZATION THEREOF

[75] Inventors: Eric Streicher, Viroflay, France; Randall M. German, State College, Pa.

[73] Assignees: l'Air Liquide; Societe Anonyme Pour l'Etude et l'Exploitation des Procedes Georges Claude, Paris Cedex, France

[21] Appl. No.: 888,644

[22] Filed: May 27, 1992

[51] Int. Cl.[5] ..... B22F 9/22

[52] U.S. Cl. ..... 75/351; 75/362; 75/369; 148/513

[58] Field of Search ..... 75/343, 351, 362, 369; 148/513

[56] References Cited

U.S. PATENT DOCUMENTS 3,904,448 9/1975 Takahashi et al. ..... 148/513

4,990,182 2/1991 Kageyama et al. ..... 75/362

FOREIGN PATENT DOCUMENTS 63-42301 2/1988 Japan ..... 75/369

*Primary Examiner*—George Wyszomierski

*Attorney, Agent, or Firm*—Oblon, Spivak, McClelland, Maier & Neustadt

[57] ABSTRACT

A process is provided for preparing carbon-containing substantially oxide-free iron powders or iron-based powders or both wherein oxygen impurities from an iron powder are removed without substantial decarburization, by heating the iron powder or iron-based powders or both under a substantially pure hydrogen atmosphere from ambient temperatures to a first intermediate temperature in an enclosure, then replacing the substantially pure hydrogen atmosphere by a substantially pure nitrogen atmosphere in the enclosure and then heating the powder to a second temperature which is higher that the first intermediate temperature, then cooling down the powder under an inert atmosphere to at least a temperature where substantially no more oxidation of the powder occurs, then removing the powder from the enclosure, the first and second temperatures being sufficient to reduce substantially all oxide impurities in the powder without substantial decarburization.

8 Claims, 1 Drawing Sheet

PROCESS FOR REDUCING OXIDES CONTAINED IN IRON POWDER WITHOUT SUBSTANTIAL DECARBURIZATION THEREOF

BACKGROUND OF THE INVENTION

1. Field of the Invention:

The present invention relates to a process for making iron powder or iron-based powder, without oxide impurities therein, which powders are suitable for making molded parts having a precise and controllable carbon content.

2. Description of the Background:

Most iron powders contain a defined carbon content that influences the properties of sintered parts made therefrom. These powders also contain impurities such as oxygen or nitrogen up to a level depending upon the process used to produce the powder. For example, carbonyl iron powders typically contain up to 0.315 wt. % of oxygen and 0.7 wt. % of nitrogen. During sintering, oxygen impurities in the powder can react with carbon and result in decarburization. Thus, an important concern of powder producers is to lower, as far as possible, the level of oxygen impurities in the powders.

A conventional process for producing iron powder is disclosed in F. L. Ebenhoech, *Carbonyl Iron Powder Production, Properties and Applications, Progress of Powder Metallurgy*, vol. 42, Princeton Ed., 1986. According to this process, treatment under pure hydrogen up to temperatures around 400° C. facilitates the removal of oxygen impurities. However, it is difficult in practice to remove oxygen with a hydrogen treatment. It is known from D. R. Ryan and L. J. Cuddy, "Effect of Atmosphere Composition on the Sintering Behavior of Iron Powder Compacts, 1990 Advances in Powder Metallurgy," vol. 2, pp. 261-77, Princeton Ed., 1991, that FeO oxides can only be reduced under pure hydrogen at temperatures above 1100° C. However, treatment of iron powder at that temperature is not possible since the powder particles would bind together to form a compact solid which is difficult to grind. Further, the partial reduction of oxides under a hydrogen atmosphere occurs with a simultaneous decarburization, in particular, since in the temperature range of 200° C. to 400° C., carbon reacts with hydrogen to produce methane.

In fact, very little information regarding the removal of oxygen impurities from iron powders without decarburization is available in the literature. However, a need exists for a process for making carbon-containing substantially oxide-free iron-based powders, which does not entail the removal of oxygen impurities by decarburization.

SUMMARY OF THE INVENTION

Accordingly, it is an object of the present invention provide a process for removing oxygen impurities from an iron powder without effecting decarburization.

It is also an object of the present invention to provide such a process using only intermediate temperatures, and avoiding the use of high temperatures.

The above objects and others which will be apparent in view of the following are provided by a process for making carbon-containing substantially oxide-free iron-based powders, wherein oxygen impurities from an iron powder are removed without substantial decarburization, which process entails heating the iron powder under a substantially pure hydrogen atmosphere from ambient temperatures to a first intermediate temperature in an enclosure, thereafter replacing the substantially pure hydrogen atmosphere by a substantially pure nitrogen atmosphere in the enclosure, and then heating the powder to a second temperature which is higher than said intermediate temperature, then cooling down the powder under the substantially pure nitrogen atmosphere to at least a temperature where substantially no further oxidation of the powder occurs, then removing the powder from the enclosure, said first and second temperatures being sufficient to reduce substantially all oxide impurities in the powder without substantial decarburization.

Figure 1A:
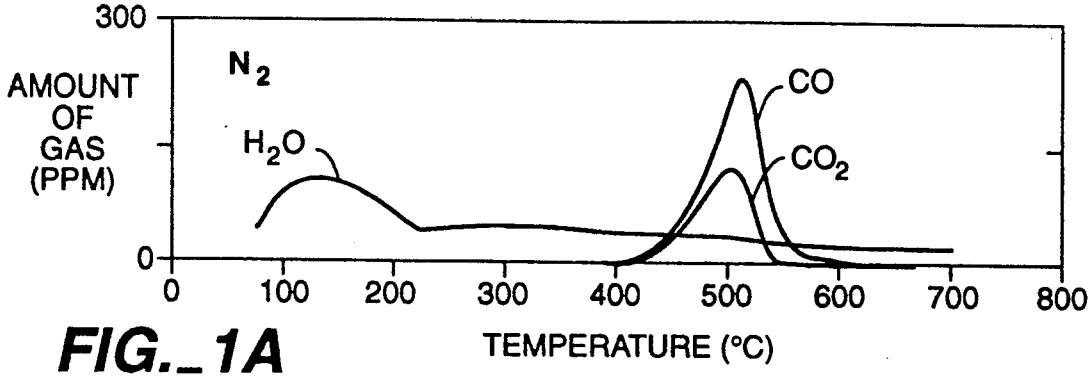
FIG. 1 generally illustrates the effect of treating carbonyl iron powders under different atmospheres, in particular.
Figure 1B:
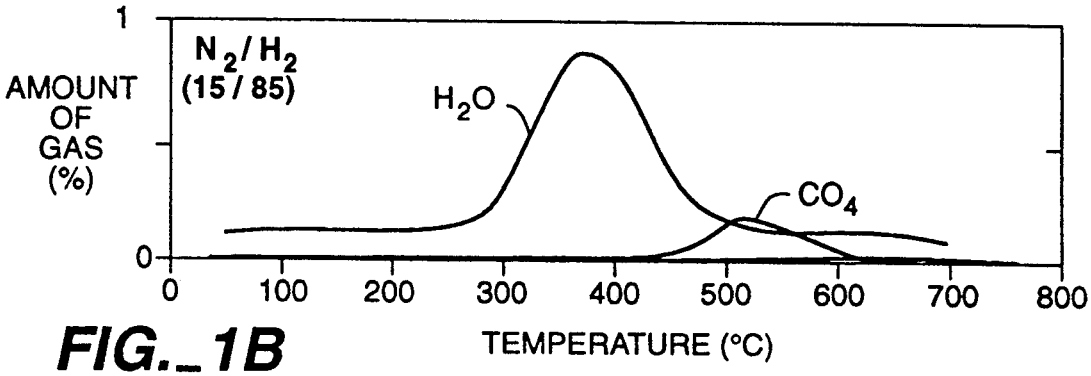
Figure 1C:
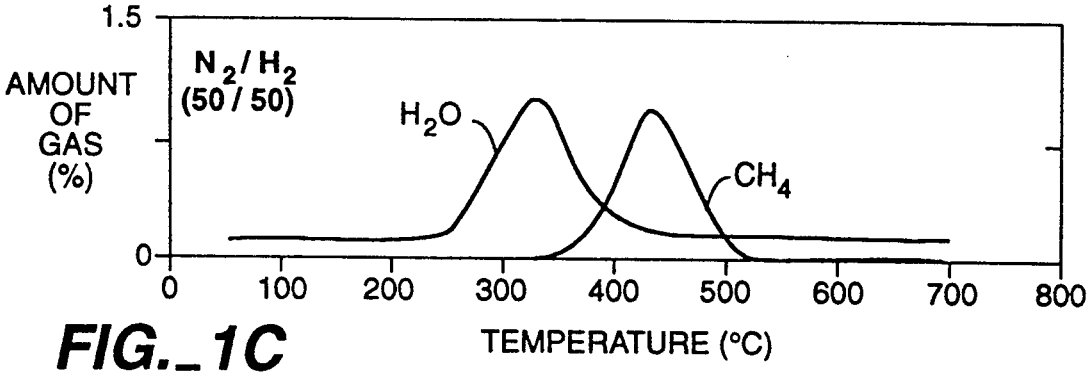

A) illustrates the effect under an atmosphere of pure $N_2$;

B) illustrates the effect under an atmosphere of $N_2/H_2$ (15/85);

C) illustrates the effect under an atmosphere of $N_2/H_2$ (50/50); and

D) illustrates the effect under an atmosphere of pure $H_2$.

DETAILED DESCRIPTION OF THE PREFERRED EMBODIMENTS

Generally, the present invention provides a process for producing iron powder substantially free of oxides, which powder is suitable for subsequently preparing molded parts having a precise and controllable carbon content.

In more detail, the present invention provides a process for making carbon-containing substantially oxide-free iron-based powders, wherein the oxygen impurities are removed, without substantial decarburization, which process entails heating the iron powder under a substantially pure hydrogen atmosphere from ambient temperature up to a first intermediate temperature in an enclosure, thereafter replacing the substantially pure hydrogen atmosphere with a substantially pure nitrogen atmosphere in the enclosure, and then heating the powder to a second temperature which is higher than the first intermediate temperature, then cooling the powder under the substantially pure nitrogen atmosphere to at least a temperature where substantially no further oxidation of the power occurs, then removing the powder from the enclosure, the first and second temperatures being sufficient to reduce substantially all oxide impurities without substantial decarburization.

Generally, the process according to the present invention may be achieved using an intermediate temperature of about 250° C. to 350° C., it is preferred that this temperature be less than about 280° C., even more preferably about 270° C. The heating step from ambient or room temperature to the intermediate temperature will preferably be a continuous process, with no hold, in order to effect the process as rapidly as possible. When this intermediate temperature is reached, a hold of at least several minutes, preferably about 30 minutes, is preferred, although the same is not absolutely necessary.

Nitrogen is then preferably substituted by hydrogen at the beginning of the hold period. However, it can be done at any time during this hold period, or even at the end thereof.

By contrast to the present invention, in accordance with conventional methodology, the following decarburization procedure has been followed prior to the present invention.

COMPARATIVE EXAMPLE

A carbonyl iron powder containing 0.86 and 0.315 wt. % of carbon and oxygen, respectively, was treated under various gas mixtures of nitrogen and hydrogen, at temperatures up to 700° C. Two types of reaction were observed, i.e. (i) reduction of the oxides and (ii) decarburization.

Reduction

Under pure hydrogen or the mixtures of nitrogen and hydrogen (85/15 and 50/50 in vol. %), the oxides reduction occurred by reaction between hydrogen and oxygen as follows:

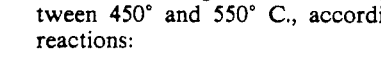

$$FeO + H_2 \rightarrow Fe + H_2O$$

The reduction shifted toward higher temperatures for decreasing amount of hydrogen in the gas mixture. In pure hydrogen, the reduction occurred between 250° and 350° C., and between 300° and 450° C. for the mixture of 85% nitrogen and I5% hydrogen. Under pure nitrogen, the oxides reduction occurred by reaction with carbon to give CO and $CO_2$ at temperatures between 450° and 550° C., according to the following reactions:

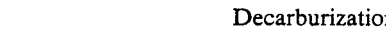

$$C + 2FeO \rightarrow 2Fe + CO_2$$

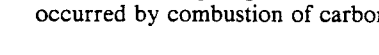

$$C + FeO \rightarrow Fe + CO$$

Decarburization

Under hydrogen gas mixtures, the decarburization occurred by combustion of carbon by hydrogen:

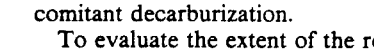

$$C + 2H_2 \rightarrow CH_4$$

The temperature range for the reaction was a function of the hydrogen concentration. In pure hydrogen, the methane peak was observed between 320 and 450° C., and 450 and 600° C. under the mixture of 85% nitrogen and 15% hydrogen. Under pure nitrogen, the oxides reduction, between 450 and 550° C., led to a concomitant decarburization.

To evaluate the extent of the reduction-decarburization reactions, carbon and oxygen contents of the powder after treatment at temperatures between 500° C. and 700° C. were determined. The results are presented in Table 1.

Under pure nitrogen, after treatment at 700° C., the carbon and oxygen contents were 0.72 and 0.042 wt. %, respectively. According to this analysis, the reduction decarburization took place by reaction between oxygen and carbon to give CO and $CO_2$. If we suppose that half of the oxygen reacted with carbon to give CO and the other half to give $CO_2$, a loss of 0.273 (0.315–0.042) wt. % of oxygen should lead to a carbon loss of 0.15 wt. %. A carbon loss of 0.14 wt. % was measured which was close to the predicted value.

A general prediction of carbon loss can be done based on the level of oxygen impurities: x wt. % of oxygen will burn 0.563 x wt. % of carbon. In other words, a treatment in pure nitrogen leads to a decarburization at a level dependent on the amount of oxygen impurities of the powder, which might be difficult to control if the starting powder has variable degree of oxidation batch to batch.

A treatment under pure hydrogen led to almost complete decarburization, 100 ppm of carbon was left after treatment at temperatures as low as 550° C. Moreover, only a fraction of the oxides was reduced, 0.087 wt. % of oxygen was left after treatment at 700° C. Because most of the carbon was burnt out by hydrogen reaction below 550° C., a further reduction of the oxides by carbon in the temperature range above 550° C. was not possible. The same results were observed with the mixture of 50% nitrogen and 50% hydrogen. Even with the mixture of 85% nitrogen and 15% hydrogen, a strong decarburization was observed. The low oxygen content in this case is probably due to the reaction between carbon and oxygen, as suggested for the treatment under pure nitrogen.

Generally, in accordance with the present invention, and by contrast with the conventional methodology in a first step iron powder or iron-based powder or both are heated in an enclosure under a substantially pure hydrogen atmosphere from ambient temperature to a first intermediate temperature. As noted above, a temperature of about 250° C. to about 350° C. is generally used. Preferably, a temperature of about 300° C. is used, more preferably about 270° C.

Then, the substantially pure hydrogen atmosphere is replaced by substantially pure nitrogen in the enclosure and the powder is heated to a second temperature which is higher than the first intermediate temperature. Generally, a temperature of at least about 550° C. to about 650° C. is used. Preferably, a temperature of at least about 600° C. is used. However, it is generally preferred if a temperature of at least about 650° C. to about 750° C. be used.

Thereafter, the powder is cooled under an inert atmosphere to at least a temperature where substantially no further oxidation of the powder occurs. Generally, the cooling will entail a return to near or at least ambient temperature.

As used herein, the term "substantially pure" for hydrogen or nitrogen means a purity of at least about 99 vol. %, preferably at least about 99.9 vol. %.

Further, as used herein the phrase "without substantial decarburization" generally means that the carbon content of the powder after treatment is at least about 75%, preferably at least about 90% of that prior to treatment. More preferably, it is at least about 95% of that prior to treatment.

Moreover, as used herein the phrase "substantially no further oxidation" means that an inert or non-oxidizing gas, such as nitrogen, is used and at a temperature where generally no further oxidation occurs.

Having generally described the present invention, reference will now be made to certain examples which are provided solely for purposes of illustrating the present invention and which are not intended to be limitative.

EXAMPLE OF THE PRESENT INVENTION

The carbonyl iron powder used above was treated in a batch furnace using a heating schedule consisting of a heating rate of 4° $C.min^{-1}$ up to 270° C., hold for 30 minutes, then heat up again at 4° $C.min^{-1}$ up to 700° C. and then cool down.

Up to 270° C., the gas was pure hydrogen with a dew point after running through the furnace of −30° C., and above 270° C., pure nitrogen with a dew point of −25° C. The volume of the furnace was 5 liters, 30 g. of powder was treated at a time using a gas flow rate of $11.min^{-1}$. The initial carbon and oxygen contents of the powder were 0.86 and 0.315 wt. %, respectively. After treatment, the carbon and oxygen contents of the loose powder compacts were 0.84 and 0.040 wt. %, respectively. Almost no decarburization and a reduction of most of the oxides were achieved. After treatment at 700° C. the loose powder compacts were easily broken down into a powder using a pestle and mortar.

The present invention may be used be used in a wide variety of applications. For example, after synthesis of an iron powder, the process herein described can be applied to reduce the oxides and obtain a powder with a precise carbon content and about no oxygen impurities. The powder can be then processed by conventional die pressing or injection molding. After sintering, if the additives used for shaping do not modify the carbon concentration, the parts would have a precise carbon content, the one of the starting powder.

Carbon and oxygen contents of loose powder compacts after heat treatment in various gas compositions are described in Table 1 hereinbelow.

In essence, the results of Table 1 are represented in FIGS. 1(A)-(D).

In more detail, FIG. 1(A) illustrates the results obtained under an atmosphere of pure $N_2$. In particular, the amounts of $H_2O$, CO and $CO_2$ produced are shown.

FIG. 1 (B) illustrates the results obtained under an atmosphere of $N_2/H_2$ (15/85). In particular, the amounts of $H_2O$ and $CH_4$ produced are shown.

FIG. 1 (C) illustrates the results obtained under an atmosphere of $N_2/H_2$ (50/50). In particular, the amounts of $H_2O$ and $CH_4$ produced are shown.

Figure 1D:
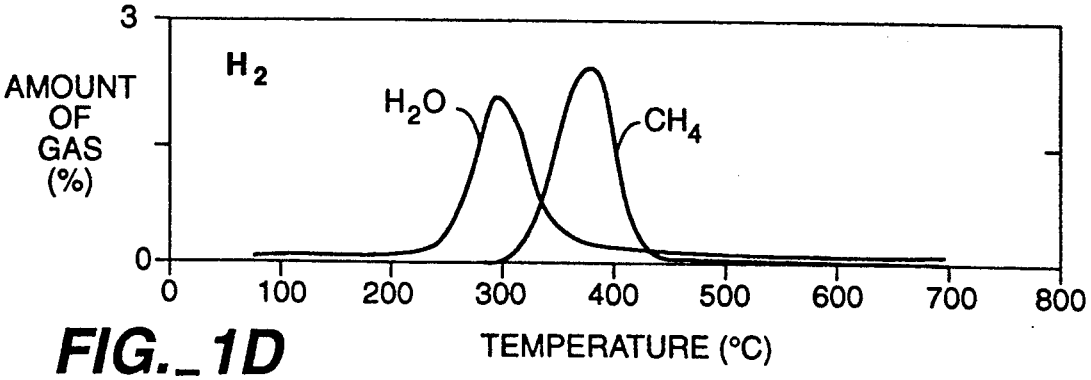

FIG. 1(D) illustrates the results obtained under an atmosphere of pure $H_2$. In particular, the amount of $H_2O$ and $CH_4$ produced are shown.

TABLE 1

Carbon and oxygen contents of loose powder compacts after heat treatment in various gas composition.

| Nature Gas | Temperature °C. | Carbon wt. % | Oxygen wt. % |
|---|---|---|---|
| None | No treatment | 0.86 | 0.315 |
| $N_2$ | 550 | 0.75 | 0.114 |
| $N_2$ | 600 | 0.75 | 0.102 |
| $N_2$ | 700 | 0.72 | 0.042 |
| $H_2$ | 550 | 0.01 | 0.127 |
| $H_2$ | 600 | 0.01 | 0.114 |
| $H_2$ | 700 | 0.01 | 0.087 |
| 85% $N_2$/15% $H_2$ | 700 | 0.54 | 0.053 |

TABLE 1-continued

Carbon and oxygen contents of loose powder compacts after heat treatment in various gas composition.

| Nature Gas | Temperature °C. | Carbon wt. % | Oxygen wt. % |
|---|---|---|---|
| 50% $N_2$/50% $H_2$ | 700 | 0.01 | 0.099 |

Having described the present invention, it will be apparent to one of ordinary skill in the art that many changes and modifications can be made thereto without departing from the spirit or scope of the invention as set forth herein.

What is claimed as new and desired to be secured by Letters Patent of the United States is:

1. A process for preparing carbon-containing substantially oxide-free iron powders or iron-based powders or both, wherein oxygen impurities from the powder are removed without substantial decarburization, comprising:

a) heating said iron-powder or iron-based powder or both under a substantially pure hydrogen atmosphere from ambient temperature to a first intermediate temperature in an enclosure, then b) replacing said substantially pure hydrogen atmosphere by a substantially pure nitrogen atmosphere in the enclosure, and then heating said powder to a second temperature which is higher than the first intermediate, then c) cooling down said powder under said substantially pure nitrogen atmosphere to at least a temperature where substantially no more oxidation of the powder occurs, and then d) removing said powder from said enclosure, the first temperature being about 250° C. to a bout 350° C., and the second temperature being at least about 600° C.

2. The process according to claim 1, wherein the first intermediate temperature is bout 270° C.

3. The process according to claim 2, wherein said intermediate temperature is held during at least several minutes.

4. The process according to claim 3, wherein said intermediate temperature is held during about 30 minutes.

5. The process according to claim 3, wherein nitrogen is substituted to hydrogen during the holding period.

6. The process according to claim 5, wherein nitrogen is substituted to hydrogen at the beginning of the hold period.

7. The process according to claim 1, wherein the enclosure is continuously heated from room temperature to said intermediate temperature.

8. The process according to claim 1, wherein the second temperature is in the range of about 650° C. to about 750° C.

* * * * *